US005458509A

United States Patent [19]

Hiraoka et al.

[11] Patent Number: 5,458,509

[45] Date of Patent: Oct. 17, 1995

[54] IGNITION COIL DEVICE FOR INTERNAL COMBUSTION ENGINE

[75] Inventors: Naoki Hiraoka; Wataru Fukui; Hideki Umemoto, all of Hyogo, Japan

[73] Assignee: Mitsubishi Denki Kabushiki Kaisha, Tokyo, Japan

[21] Appl. No.: 277,751

[22] Filed: Jul. 20, 1994

[30] Foreign Application Priority Data

Oct. 4, 1993 [JP] Japan ..... 5-248143

[51] Int. Cl.[6] ..... H01R 4/48

[52] U.S. Cl. ..... 439/700; 439/125

[58] Field of Search ..... 439/125–128, 439/700, 819, 824, 129

[56] References Cited

U.S. PATENT DOCUMENTS

| | | | |
|---|---|---|---|
| 2,169,689 | 8/1939 | Gardner | 439/125 |
| 2,943,139 | 6/1960 | Skunda | 439/125 |
| 5,358,418 | 10/1994 | Carmichael | 439/700 |

FOREIGN PATENT DOCUMENTS 63-116414 5/1988 Japan .

*Primary Examiner*—Gary F. Paumen
*Attorney, Agent, or Firm*—Sughrue, Mion, Zinn, Macpeak & Seas

[57] ABSTRACT

A ignition coil device for an internal combustion engine includes: a tubular high tension terminal which is electrically connected to a secondary output terminal of an ignition coil and has a side face portion, and one end of which is open; a first member accommodated in the tubular portion of the high tension terminal and fixed in the side face portion; a coil-shaped electrically conductive spring member which is accommodated in the tubular portion of the high tension terminal, and one end portion of which is wound around the first member a plurality of times in contact therewith; a second member accommodated in the tubular portion of the high tension terminal and having a shaft portion around which another end portion of the electrically conductive spring member is wound a plurality of times in contact therewith and a contacting portion which is electrically connected to a conductor of an ignition cable in contact therewith; and a retaining portion for retaining the conductor in a state in which the conductor compresses the electrically conductive spring member.

8 Claims, 3 Drawing Sheets

IGNITION COIL DEVICE FOR INTERNAL COMBUSTION ENGINE

BACKGROUND OF THE INVENTION

The present invention relates to an ignition coil device for an internal combustion engine, and more particularly to a connecting portion between an ignition cable and a high tension terminal which is connected to a secondary output terminal of an ignition coil.

A configuration of a conventional ignition coil device for an internal combustion engine is shown in FIG. 5. Reference numeral 1 denotes an outer casing of an ignition coil which is formed of a synthetic resin material, and this outer casing 1 has a projection la. Numeral 2 denotes a tubular high tension terminal embedded in the projection la. This tubular high tension terminal 2 is connected to a secondary output terminal 3 for outputting a secondary voltage occurring in an unillustrated ignition coil, and is provided with an annular recess 2*a*. It should be noted that the connection between the secondary output terminal 3 and the high tension terminal 2 is effected by welding, soldering or the like. Numeral 4 denotes a tubular terminal caulked at a tip of an ignition cable 5 for supplying the secondary voltage to an unillustrated ignition plug. This tubular terminal 4 has an annular protrusion 4*a*. It should be noted that the recess 2*a* constitutes a retaining portion for preventing the ignition cable 5 from coming off the high tension terminal 2. Namely, the conventional ignition coil device for an internal combustion engine is arranged such that the ignition cable 5 is inserted into the tubular portion of the high tension terminal 2 to allow the projection 4*a* to be fitted in the recess 2*a*, and the connecting portion is subsequently covered with a protection cap 6 formed of rubber or the like.

Since the conventional ignition coil device for an internal combustion engine is arranged as described above, there has been a problem in that component parts vibrate by mechanical vibrations during the operation of the internal combustion engine, and a gap is caused between the high tension terminal 2 and the terminal 4 due to a difference in natural vibration, thereby making it impossible to maintain the contact between the terminals 2 and 4 in a satisfactory state.

To overcome this drawback, an ignition coil for an internal combustion engine disclosed in, for example, Japanese Patent Unexamined Publication (Kokai) Sho-63-116414/(1988) has been proposed. FIG. 6 shows a configuration of the ignition coil for an internal combustion engine proposed in the above-mentioned publication. In FIG. 6, component parts or portions that are denoted by the same reference numerals as those of FIG. 5 show component parts or portions identical or equivalent to those of FIG. 5. In FIG. 6, reference numeral 7 denotes an ignition plug; 8, a terminal of the ignition plug 7; and 9, an electrically conductive coil spring in which a portion of its inside diameter is made to conform to the outside diameter of the terminal 8. Namely, the ignition coil for an internal combustion engine shown in FIG. 6 is designed to absorb vibrations of component parts caused by the mechanical vibrations during the operation of the internal combustion engine by means of the conductive coil spring.

With the ignition coil shown in FIG. 6, however, the high tension terminal 2 and the conductive coil spring 9 are merely in contact with each other only at a left end of the conductive coil spring 9. Accordingly, there has been a drawback in that the high tension terminal 2 and the conductive coil spring 9 repeat contact and non-contact due to the difference in natural vibration between the ignition coil for an internal combustion engine and the conductive coil spring 9.

In addition, with the ignition coil shown in FIG. 6, other drawbacks are encountered in that the conductive coil spring 9 comes off during an assembling operation, and that a mating component of the conductive coil spring 9 is required to have a predetermined shape, i.e., the outside diameter of the terminal 8 is required to conform to an inside-diameter portion of the conductive coil spring 9.

SUMMARY OF THE INVENTION

The present invention has been devised to overcome the above-described problems, and the object of the present invention is to obtain an ignition coil device for an internal combustion engine capable of maintaining the contact between the high tension terminal of the ignition coil device for an internal combustion engine and the terminal of the ignition cable in a satisfactory state even if vibrations occur in the internal combustion engine.

The ignition coil device for an internal combustion engine in accordance with the present invention comprises: a tubular high tension terminal which is electrically connected to a secondary output terminal of an ignition coil and has a tubular portion and a side face portion, and one end of which is open; a first member accommodated in the tubular portion of the high tension terminal and fixed in an inner wall of the side face portion; a coil-shaped electrically conductive spring member which is accommodated in the tubular portion of the high tension terminal, and one end portion of which is wound around the first member a plurality of times in contact therewith; a second member accommodated in the tubular portion of the high tension terminal and having a shaft portion around which another end portion of the electrically conductive spring member is wound a plurality of times in contact therewith and a contacting portion which is electrically connected to a conductor of an ignition cable in contact therewith; and a retaining portion for retaining the conductor in a state in which the conductor compresses the electrically conductive spring member via the second member.

In the ignition coil device for an internal combustion engine in accordance with the present invention, the first member is constituted by a projecting portion which is formed integrally on the inner wall of the side face portion in such a manner as to project in an axial direction of the tubular portion.

In the ignition coil device for an internal combustion engine in accordance with the present invention, the first member is a projecting portion having a tapered side face portion, one end portion of the electrically conductive spring member being clamped by the inner wall of the tubular portion of the high tension terminal and the side face portion of the projecting portion.

In the ignition coil device for an internal combustion engine in accordance with the present invention, a groove portion for engagement with the electrically conductive spring member is provided in the projecting portion.

In the ignition coil device for an internal combustion engine in accordance with the present invention, groove portions for engagement with the electrically conductive spring member are respectively provided in the first member and the shaft portion.

In the ignition coil device for an internal combustion engine in accordance with the present invention, the side face portion and the first member are fixed by means of threaded engagement or caulking.

In the ignition coil device for an internal combustion engine in accordance with the present invention, the first member is constituted by a portion of a screw member fixed in the side face portion by means of threaded engagement.

According to the invention, the ignition coil device for an internal combustion engine is capable of maintaining the contact between the high tension terminal of the ignition coil device for an internal combustion engine and the terminal of the ignition cable in a satisfactory state even if vibrations occur in the component parts due to mechanical vibrations during the operation of the internal combustion engine.

In addition, the ignition coil device for an internal combustion engine prevents the electrically conductive spring member and the second member from coming off.

In addition, in the ignition coil device for an internal combustion engine, since the first member is formed integrally on the high tension terminal, a faulty contact between the two members does not occur.

In addition, in the ignition coil device for an internal combustion engine, since the side face portion of the first member is tapered, the area of contact between the first member and the electrically conductive spring member increases.

In addition, the operation is facilitated when the electrically conductive spring member is pressure-fitted onto the first member.

In addition, in the ignition coil device for an internal combustion engine in accordance with the present invention, since the first member has a groove portion for engagement with the electrically conductive spring member, the first member and the electrically conductive spring member engage each other, so that the contact between the two members is further strengthened, and the area of contact increases.

In addition, in the ignition coil device for an internal combustion engine in accordance with the present invention, since groove portions for engagement with the electrically conductive spring member are respectively provided in the first member and the shaft portion, it is possible to reliably prevent the electrically conductive spring member and the second member from coming off.

In addition, in the ignition coil device for an internal combustion engine in accordance with the present invention, since the side face portion and the first member are fixed by means of threaded engagement or caulking, the high tension terminal and the first member can be reliably made to contact each other.

In addition, in the ignition coil device for an internal combustion engine in accordance with the present invention, since the first member can be constituted by a general-purpose screw member, the component can be made inexpensive.

DETAILED DESCRIPTION OF PREFERRED EMBODIMENTS

First Embodiment

Figure 1:
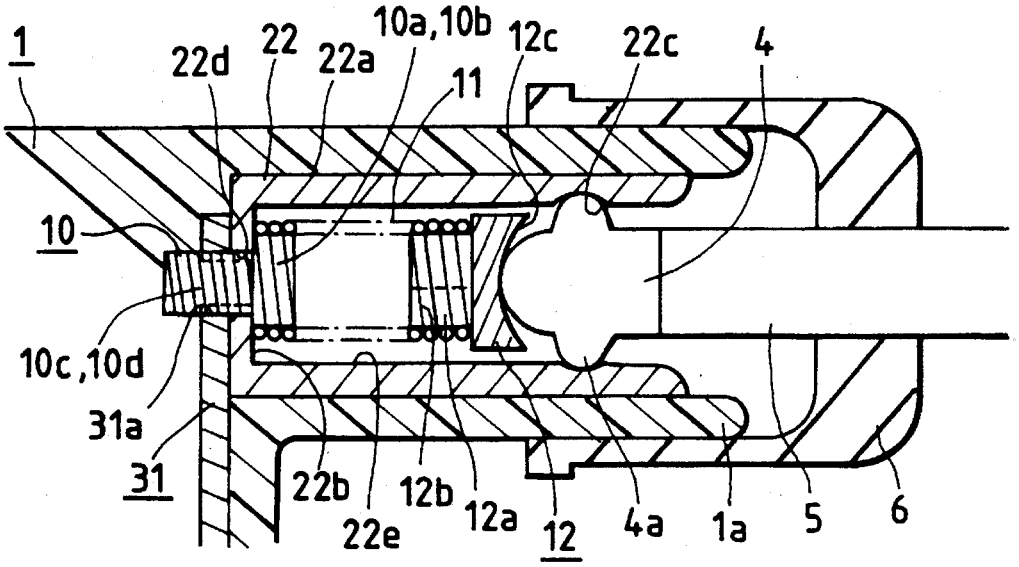
FIG. 1 is a schematic diagram illustrating a first embodiment of the present invention.
Figure 5:
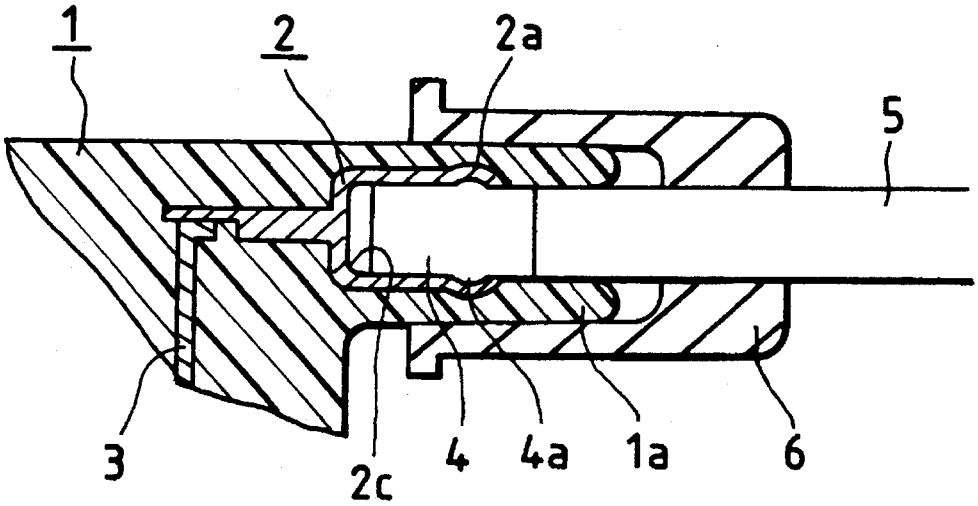
FIG. 5 PRIOR ART
FIG. 5 is a schematic diagram illustrating a conventional ignition coil device for an internal combustion engine.
Figure 6:
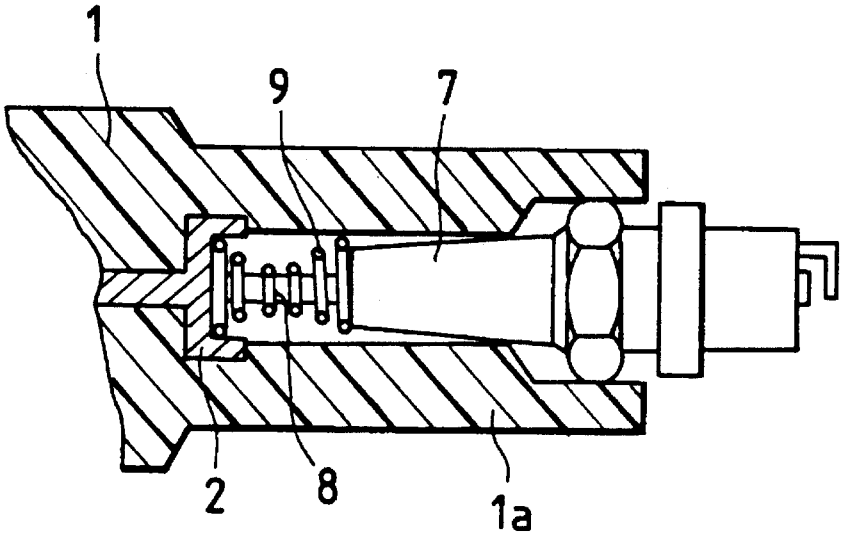
FIG. 6 PRIOR ART
FIG. 6 is a schematic diagram illustrating another conventional ignition coil device for an internal combustion engine.

Referring now to the drawings, a description will be given of the embodiments of the present invention. FIG. 1 is a schematic diagram illustrating a first embodiment of the present invention. It should be noted that, in FIG. 1, component parts or portions that are denoted by the same reference numerals as those of FIG. 5 show component parts or portions identical or equivalent to those of FIG. 5. Reference numeral 22 denotes a tubular high tension terminal which is formed of an electrically conductive metal and has a tubular portion 22*a* and a side face portion 22*b*, and one end of which is open. The high tension terminal 22 has an annular recess 22*c* serving as a retaining portion, a thread groove 22*d* provided in the side face portion, and an accommodating portion 22*e* on the inner side of the tubular portion. Numeral 31 denotes a secondary output terminal for outputting a secondary voltage generated by an unillustrated ignition coil, and this secondary output terminal 31 is provided with a hole 31*a* having a thread groove cut at a distal end thereof. Numeral 10 denotes a hold bush made of an electrically conductive metal, and is formed into a tubular shape having a stepped portion. The hold bush 10 has a helical thread groove 10*b* formed at a large-diameter portion 10*a*, and a helical thread groove 10*d* at a small-diameter portion 10*c*. Here, the large-diameter portion 10*a* constitutes a first member around which an electrically conductive coil spring 11 which will be described later is wound. The small-diameter portion 10*c* having the thread groove 10*d* is threadedly engaged with the thread groove 22*d* provided on the side face portion 22*b* of the high tension terminal 22, thereby constituting a fixing portion for fixing the high tension terminal 22 and the large-diameter portion 10*a*. The small-diameter portion 10*c* is threadedly engaged with the secondary output terminal 31 and the high tension terminal 22, and the three members positively contact each other electrically and mechanically. Numeral 11 denotes the electrically conductive coil spring which is an electrically conductive spring member accommodated in the accommodating portion 22*e* of the high tension terminal 22, and is constituted by a spring which is a coil-shaped resilient member made of an electrically conductive metal. This electrically conductive coil spring 11 has one end portion wound a plurality of times in such a manner as to bury the thread groove 10*b* in the hold bush 10. In addition, the wire diameter of the conductive coil spring 11 is made to be identical to or smaller than the groove widths of the thread grooves 10*b* and 10*d*. Accordingly, the conductive coil spring 11 is in contact with the hold bush 10 along the thread grooves. Consequently, the area of contact between the large-diameter portion 10*a* of the hold bush 10 and the conductive coil spring 11 becomes large, so that the two members positively contact each other electrically and mechanically. Numeral 12 denotes a contact bush serving as a second member which is formed of an electrically conductive metal and is accommodated in the accommodating portion 22*e*. The contact bush 12 has a helical thread groove 12*b* provided on a shaft portion 12*a*, and a recessed portion 12*c* which is a contacting portion for receiving a terminal 4 of an ignition cable 5. Another end portion of the conductive coil spring 11 is wound a plurality of times in the thread groove 12*b* of the shaft portion 12*a* of the contact bush 12 in such a manner as to fill the groove portion. The conductive coil spring 11 and the contact bush 12 positively contact each other electrically and mechanically. Numeral 22*c* denotes a recess serving as a retaining portion provided circumferentially on the tubular portion 22*a* of the high tension terminal 22. When the ignition cable 5 is inserted into the accommodating portion 22*e* of the high tension terminal 22, this recess 22*c* fits to a projection 4*a* provided on the terminal 4, i.e., a conductive member of the ignition cable 5, and retains the terminal 4 in a state in which the conductive coil spring 11 is compressed. As a result, the conductive coil spring 11 has a sufficient pressing force. The contact bush 12 receives this pressing force, so that the recessed portion 12*c* is pressed against and brought into contact with the terminal 4 of the ignition cable 5. Accordingly, since the contact bush 12 is brought into pressure contact with the terminal 4 of the ignition cable 5 by a sufficient pressing force, even if vibrations occur due to the operation of the internal combustion engine, the vibrations are absorbed by the conductive coil spring 11, thereby allowing a satisfactory electrical contact to be constantly obtained.

In this embodiment which is arranged as described above, the high tension terminal 22 and the hold bush 10 are fixed by threaded engagement. In addition, one end portion of the conductive coil spring 11 is wound a plurality of times in the helical thread groove 10*b* of the large-diameter portion 10*a* of the hold bush 10 in such a manner as to fill that groove portion. The other end portion of this conductive coil spring 11 is wound a plurality of times in such a manner as to fill the groove portion of the thread groove 12*b* provided in the shaft portion 12*a* of the contact bush 12. The contact bush 12 receives a pressing force of the conductive coil spring 11, so that the recessed portion 12*c* is pressed against and brought into contact with the terminal 4. The terminal 4 is in contact with and is retained by the recess 22*c* of the high tension terminal 22. Consequently, since the contact from the high tension terminal 22 to the terminal 4 is positively provided electrically and mechanically, even if vibrations occur due to the operation of the internal combustion engine, the conductive coil spring 11 and the hold bush 10 or the contact bush 12, for instance, are prevented from becoming completely separate, and the two members are constantly in contact with each other in a satisfactory state.

In addition, the conductive coil spring 11 has one end portion wound in the thread groove 10*b* of the hold bush 10 and the other end portion wound in the thread groove 12*b* of the contact bush 12. Accordingly, there is no danger of the conductive coil spring 11 or the contact bush 12 coming off during an assembling operation.

In addition, since the contact bush 12 is provided, the shape of the terminal 4 of the ignition cable 5 is not restrained by the shape of the conductive coil spring 11.

In addition, since the recessed portion 12*c* is adopted for the contacting portion of the contact bush 12, its contact with the terminal 4 can be maintained in a satisfactory state.

Furthermore, since the contact between the secondary output terminal 31 and the high tension terminal 22 is effected by means of threaded engagement, the step of welding or soldering these two members can be omitted.

It should be noted that although, in the above-described embodiment, a description has been given of a case where the wire diameter of the conductive coil spring 11 is made to be identical to or smaller than the groove widths of the thread grooves 10*b* and 10*d*, it goes without saying that it is possible to obtain the advantages of preventing the component parts from coming off and of increasing the contact area even in cases where the wire diameter of the conductive coil spring 11 is greater than the groove widths of the thread grooves 10*b* and 10*d*.

In the above-described first embodiment, the small-diameter portion 10*c* of the hold bush 10 is provided with the thread groove 10*d*, and the small-diameter portion 10*c* of the hold bush 10 is fixed in the high tension terminal 22 by means of threaded engagement. Instead of providing the thread groove, the fixing of the hold bush 10 in the high tension terminal 22 may be effected by means of caulking or the like.

In that case, the secondary output terminal 31 may be caulked simultaneously. At that juncture, the thread groove 31*a* in the hole of the secondary output terminal can be omitted.

Although, in the above-described first embodiment, the shape of the hold bush 10 is formed in a tubular shape having a stepped portion, a stepless tubular shape may be adopted therefor.

Although, in the above-described first embodiment, a the recess 22*c* serving as the retaining portion is provided in the high tension terminal 22, this recess 22*c* may not be provided. In this case, an inner wall surface of the high tension terminal 22 acts as a retaining portion for retaining the terminal 4. In addition, when the inner wall surface of the high tension terminal 22 is formed as the retaining portion, a plurality of irregularities may be formed on that inner wall surface by means of shot blasting or the like so as to increase a frictional force.

In addition, as the retaining portion, a projection may be provided on the high tension terminal 22. Incidentally, it is more preferable if this projection is provided with resiliency.

Although, in the above-described first embodiment, the secondary output terminal 31 and the high tension terminal 22 are fixed by means of threaded engagement or caulking, these members may be connected by means of welding, soldering or the like in the conventional manner.

Second Embodiment

Although the hold bush 10 is used in the above-described first embodiment, this may be arranged by a screw, i.e., a general-purpose item which is generally used.

Figure 2:
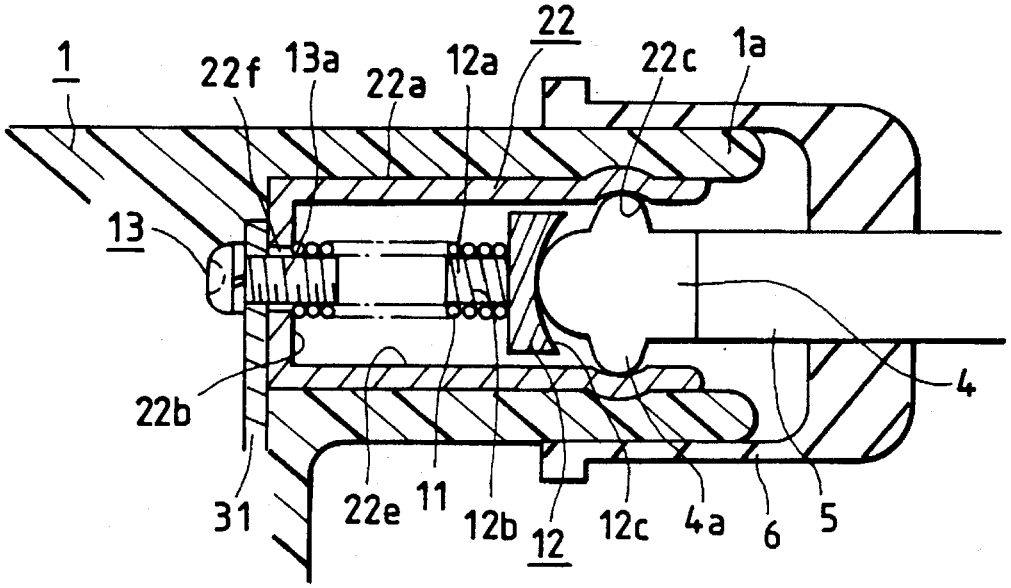
FIG. 2 is a schematic diagram illustrating a second embodiment of the present invention.

Hereafter, a description will be given of a second embodiment with reference to FIG. 2. FIG. 2 is a schematic diagram illustrating the second embodiment. In the drawing, reference numeral 13 denotes a screw, i.e., a general-purpose item. A portion of this screw, i.e., a distal end portion 13*a* projecting into the accommodating portion 22*e* of the high tension terminal 22 constitutes the first member. The screw 13 fastens the secondary output terminal 31 and the high tension terminal 22 by means of a thread groove 22*f* provided in the side face portion of the high tension terminal 22.

In accordance with the second embodiment, since the hold bush 10 having a predetermined shape is substituted by the screw 13, i.e., a general-purpose item which is generally used, the ignition coil device can be arranged at a lower cost.

In addition, the connection between the secondary output terminal and the high tension terminal can be effected simply. It should be noted that, at this juncture, there is no need to provide a thread groove in the hole of the secondary output terminal 31.

Third Embodiment

Figure 3:
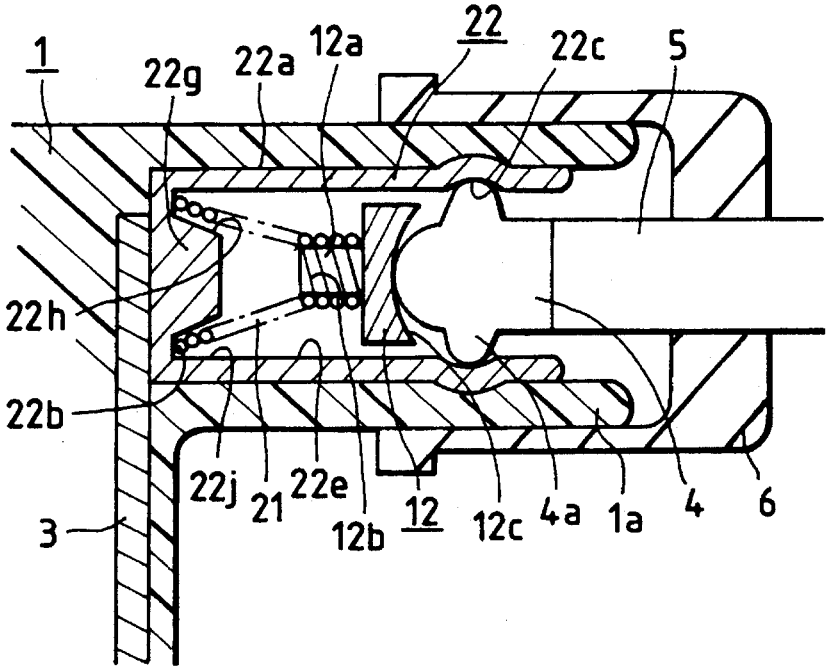
FIG. 3 is a schematic diagram illustrating a third embodiment of the present invention.

FIG. 3 is a schematic diagram illustrating a third embodiment of the present invention. Reference numeral 22*g* denotes a projecting portion which is formed integrally on an inner wall of the side face portion 22*b* of the high tension terminal 22 and also has a tapered groove 22*h* on the side face portion. This projecting portion 22*g* projects in the axial direction of the tubular portion. The outside diameter of the largest portion of the projecting portion 22*g* is smaller than the diameter of an inner peripheral surface 22*j* of the accommodating portion 22*e* of the high tension terminal 22 by the portion of the wire diameter of an electrically conductive coil spring 21. In this third embodiment, the conductive coil spring 21 expands along the tapered side face portion 22*h* when the conductive coil spring 21 is pressure-fitted onto the projecting portion 22*g*, and is wound a plurality of times in contact with this side face portion 22*h*. In addition, the distal end portion of the conductive coil spring 21 is clamped by the inner peripheral surface 22*j* of the high tension terminal 22 and the largest portion of the side face portion 22*h* of the projecting portion 22*g*.

In accordance with this third embodiment, it is possible to omit the step of fixing the hold bush 10 or the screw 13 in the high tension terminal 2.

In addition, since the first member is formed integrally with the high tension terminal 22, there is no faulty contact between the two members.

In addition, since the conductive coil spring 21 is superposed on the tapered side face portion 22*h* at a plurality of portions thereof, it is possible to enlarge the area of contact between the high tension terminal 22 and the conductive coil spring 21.

In addition, since the distal end portion of the conductive coil spring 21 is clamped by the inner peripheral surface 22*j* of the high tension terminal 22 and the largest portion of the side face portion 22*h* of the projecting portion 22*g*, the conductive coil spring 21 is prevented from coming off in the assembling operation.

In the above-described third embodiment, a helical thread groove may be provided in the projecting portion 22*g*. This makes more reliable the prevention of the conductive coil spring 21 from coming off, and at the same time the area of contact between the projecting portion 22*g* and the conductive coil spring 21 can be made large.

Fourth Embodiment

Figure 4:
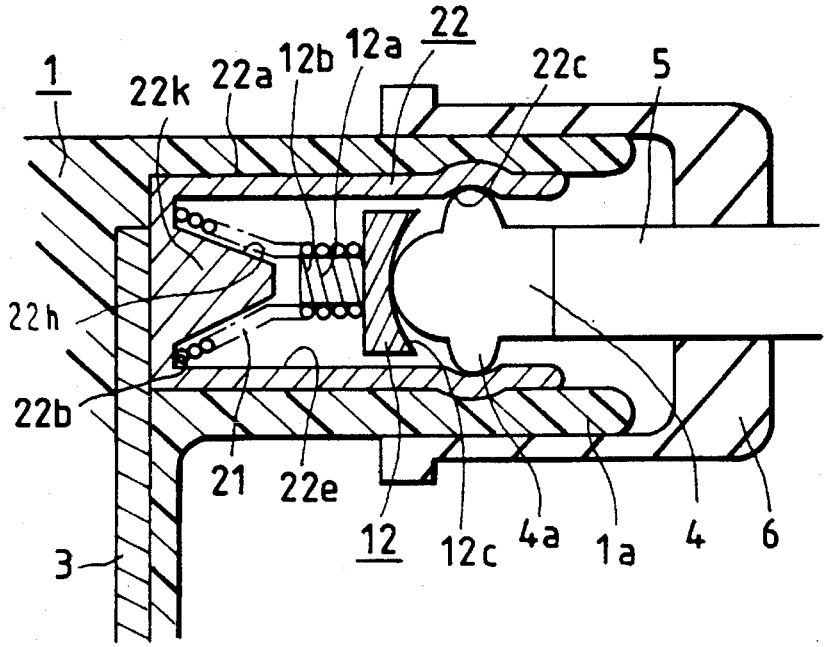
FIG. 4 is a schematic diagram illustrating a fourth embodiment of the present invention.

FIG. 4 is a schematic diagram illustrating a fourth embodiment which is a further improvement of the third embodiment of the present invention.

In this fourth embodiment, the outside diameter of a distal end portion of a projecting portion 22*k* is made smaller than the inside diameter of the conductive coil spring 21, and the other arrangements are similar to those of the above-described third embodiment.

In accordance with this fourth embodiment, since the outside diameter of the distal end portion of the projecting portion 22*k* is made smaller than the inside diameter of the conductive coil spring 21, the side face portion of the projecting portion 22*k* serves as a guide when the conductive coil spring 21 is pressure-fitted onto the projecting portion 22*k* during the assembling operation the side face portion also has a groove 22.

Accordingly, the assembling of the device can be effected more simply.

Although, in the above-described embodiments, a helical thread groove is provided in the projecting portion or the contact bush, a plurality of parallel grooves may be provided.

As described above, in accordance with the present invention, it is possible to obtain an ignition coil device for an internal combustion engine capable of maintaining the contact between the high tension terminal of the ignition coil device for an internal combustion engine and the terminal of the ignition cable in a satisfactory state even if vibrations occur due to the operation of the internal combustion engine.

What is claimed is:

1. An ignition coil device for an internal combustion engine comprising:

a tubular high tension terminal electrically connected to a secondary output terminal of an ignition coil, said tubular high tension terminal having a tubular portion and a side face portion, and one end of said tubular high tension terminal being open;

a first member accommodated in said tubular portion of said high tension terminal and fixed to an inner wall of said side face portion;

a coil-shaped electrically conductive spring member accommodated in said tubular portion of said high tension terminal, and one end portion of said spring member being wound around said first member a plurality of times in contact therewith;

a second member accommodated in said tubular portion of said high tension terminal and having a shaft portion around which another end portion of said electrically conductive spring member is wound a plurality of times in contact therewith and a contacting portion which is electrically connected to a conductor of an ignition cable in contact therewith; and a retaining portion for retaining said conductor in a state in which said conductor compresses said electrically conductive spring member via said second member.

2. An ignition coil device for an internal combustion engine according to claim 1, wherein said first member is a projecting portion which is formed integrally on the inner wall of said side face portion in such a manner as to project in an axial direction of said tubular portion.

3. An ignition coil device for an internal combustion engine according to claim 2, wherein said first member is a projecting portion having a tapered side face portion, said one end portion of said electrically conductive spring member being clamped by the inner wall of said tubular portion of said high tension terminal and said side face portion of said projecting portion.

4. An ignition coil device for an internal combustion engine according to claim 2, wherein a groove portion for engagement with said electrically conductive spring member is provided in said projecting portion.

5. An ignition coil device for an internal combustion engine according to claim 3, wherein a groove portion for engagement with said electrically conductive spring member is provided in said projecting portion.

6. An ignition coil device for an internal combustion engine according to claim 1, wherein groove portions for engagement with said electrically conductive spring member are respectively provided in said first member and said shaft portion.

7. An ignition coil device for an internal combustion engine according to claim 1, wherein said side face portion and said first member are fixed by means of threaded engagement or caulking.

8. An ignition coil device for an internal combustion engine according to claim 1, wherein said first member is a portion of a screw member fixed in said side face portion by means of threaded engagement.

* * * * *